US006178568B1

(12) United States Patent
Boulieris

(10) Patent No.: US 6,178,568 B1
(45) Date of Patent: Jan. 30, 2001

(54) TOILET AND BIDET ASSEMBLY

(76) Inventor: Spiros Boulieris, 21 Overlea Blvd. #1503, East York (CA), M4H 1P2

( * ) Notice: Under 35 U.S.C. 154(b), the term of this patent shall be extended for 0 days.

(21) Appl. No.: 09/494,368

(22) Filed: Jan. 31, 2000

(51) Int. Cl.[7] ..... A47K 3/20
(52) U.S. Cl. ..... 4/420.4; 4/448
(58) Field of Search ..... 4/443, 444, 445, 4/446, 447, 448, 420.2, 420.4; 239/104, 570, 571

(56) References Cited

U.S. PATENT DOCUMENTS

| | | | | |
|---|---|---|---|---|
| D. 355,246 | | 2/1995 | Kawamura et al. . | |
| 3,925,826 | * | 12/1975 | Huyot et al. . | |
| 4,195,369 | * | 4/1980 | Lesick . | |
| 4,422,189 | | 12/1983 | Couvrette . | |
| 4,441,219 | | 4/1984 | Epstein . | |
| 4,653,126 | * | 3/1987 | Morandi et al. | 4/420.2 |
| 4,691,391 | | 9/1987 | Kuo . | |
| 4,881,282 | * | 11/1989 | George et al. | 4/605 |
| 4,967,423 | | 11/1990 | Aoyama . | |
| 5,241,712 | | 9/1993 | Mahoney . | |
| 5,287,566 | * | 2/1994 | Azada | 4/420.4 |

* cited by examiner

*Primary Examiner*—Henry J. Recla
*Assistant Examiner*—Khoa D. Huynh

(57) ABSTRACT

A toilet and bidet assembly for directing a stream of water toward the anus or the genital parts of an individual sitting on a toilet includes a toilet that has a toilet bowl. A main member is coupled to the toilet bowl. The main member has a mounting portion and a bidet portion. The bidet portion extends from the mounting portion into an interior space defined by the bowl portion of the toilet bowl. A spray nozzle is coupled to the bidet portion of the main member. The spray nozzle is positioned in a manner such that it directs water towards the anus of a user when the user is seated on the toilet seat. In addition, a cover member is pivotally coupled to the bidet portion for covering and uncovering the spray nozzle.

11 Claims, 3 Drawing Sheets

TOILET AND BIDET ASSEMBLY

BACKGROUND OF THE INVENTION

1. Field of the Invention

The present invention relates to bidets mounted on a toilet bowl and more particularly pertains to a new toilet and bidet assembly for directing a stream of water toward the anus or the genital parts of an individual sitting on a toilet.

2. Description of the Prior Art

The use of bidets mounted on a toilet bowl is known in the prior art. More specifically, bidets mounted on a toilet bowl heretofore devised and utilized are known to consist basically of familiar, expected and obvious structural configurations, notwithstanding the myriad of designs encompassed by the crowded prior art that have been developed for the fulfillment of countless objectives and requirements.

Known prior art includes U.S. Pat. No. 4,441,219; U.S. Pat. No. 4,422,189; U.S. Pat. No. 4,967,423; U.S. Pat. No. 4,691,391; U.S. Pat. No. 5,241,712; and U.S. Pat. No. Des. 355,246.

While these devices fulfill their respective, particular objectives and requirements, the aforementioned patents do not disclose a new toilet and bidet assembly. The inventive device includes a toilet that has a toilet bowl. A main member is coupled to the toilet bowl. The main member has a mounting portion and a bidet portion. The bidet portion extends from the mounting portion into an interior space defined by the bowl portion of the toilet bowl. A spray nozzle is coupled to the bidet portion of the main member. The spray nozzle is positioned in a manner such that it directs water towards the anus of a user when the user is seated on the toilet seat. In addition, a cover member is pivotally coupled to the bidet portion for covering and uncovering the spray nozzle.

In these respects, the toilet and bidet assembly according to the present invention substantially departs from the conventional concepts and designs of the prior art, and in so doing provides an apparatus primarily developed for the purpose of directing a stream of water toward the anus or the genital parts of an individual sitting on a toilet.

SUMMARY OF THE INVENTION

In view of the foregoing disadvantages inherent in the known types of bidets mounted on a toilet bowl now present in the prior art, the present invention provides a new toilet and bidet assembly construction wherein the same can be utilized for directing a stream of water toward the anus or the genital parts of an individual sitting on a toilet.

The general purpose of the present invention, which will be described subsequently in greater detail, is to provide a new toilet and bidet assembly apparatus and method which has many of the advantages of the bidets mounted on a toilet bowl mentioned heretofore and many novel features that result in a new toilet and bidet assembly which is not anticipated, rendered obvious, suggested, or even implied by any of the prior art bidets mounted on a toilet bowl, either alone or in any combination thereof.

To attain this, the present invention generally comprises a toilet that has a toilet bowl. A main member is coupled to the toilet bowl. The main member has a mounting portion and a bidet portion. The bidet portion extends from the mounting portion into an interior space defined by the bowl portion of the toilet bowl. A spray nozzle is coupled to the bidet portion of the main member. The spray nozzle is positioned in a manner such that it directs water towards the anus of a user when the user is seated on the toilet seat. In addition, a cover member is pivotally coupled to the bidet portion for covering and uncovering the spray nozzle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet and bidet assembly apparatus and method which has many of the advantages of the bidets mounted on a toilet bowl mentioned heretofore and many novel features that result in a new toilet and bidet assembly which is not anticipated, rendered obvious, suggested, or even implied by any of the prior art bidets mounted on a toilet bowl, either alone or in any combination thereof.

It is another object of the present invention to provide a new toilet and bidet assembly that may be easily and efficiently manufactured and marketed.

It is a further object of the present invention to provide a new toilet and bidet assembly that is of a durable and reliable construction.

An even further object of the present invention is to provide a new toilet and bidet assembly which is susceptible of a low cost of manufacture with regard to both materials and labor, and which accordingly is then susceptible of low prices of sale to the consuming public, thereby making such toilet and bidet assembly economically available to the buying public.

Still yet another object of the present invention is to provide a new toilet and bidet assembly that provides in the apparatuses and methods of the prior art some of the advantages thereof, while simultaneously overcoming some of the disadvantages normally associated therewith.

Still another object of the present invention is to provide a new toilet and bidet assembly for directing a stream of water toward the anus or the genital parts of an individual sitting on a toilet.

Yet another object of the present invention is to provide a new toilet and bidet assembly that includes a toilet that has a toilet bowl. A main member is coupled to the toilet bowl. The main member has a mounting portion and a bidet portion. The bidet portion extends from the mounting portion into an interior space defined by the bowl portion of the toilet bowl. A spray nozzle is coupled to the bidet portion of the main member. The spray nozzle is positioned in a manner such that it directs water towards the anus of a user when the user is seated on the toilet seat. In addition, a cover member is pivotally coupled to the bidet portion for covering and uncovering the spray nozzle.

Still yet another object of the present invention is to provide a new toilet and bidet assembly that may be easily attached to an existing toilet.

Even still another object of the present invention is to provide a new toilet and bidet assembly that provides increased hygiene.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
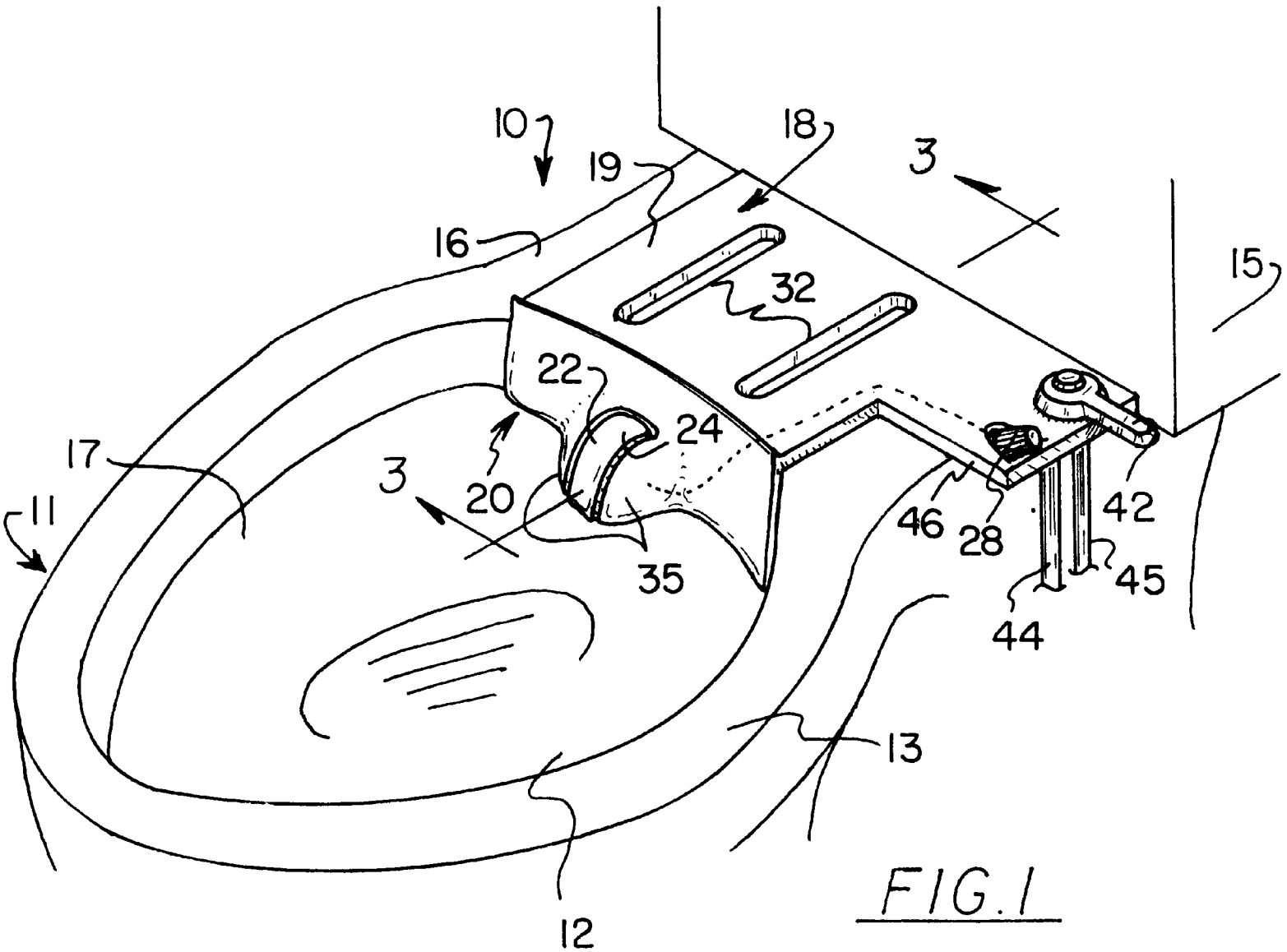
FIG. 1 is a schematic perspective view of a new toilet and bidet assembly according to the present invention.
Figure 2:
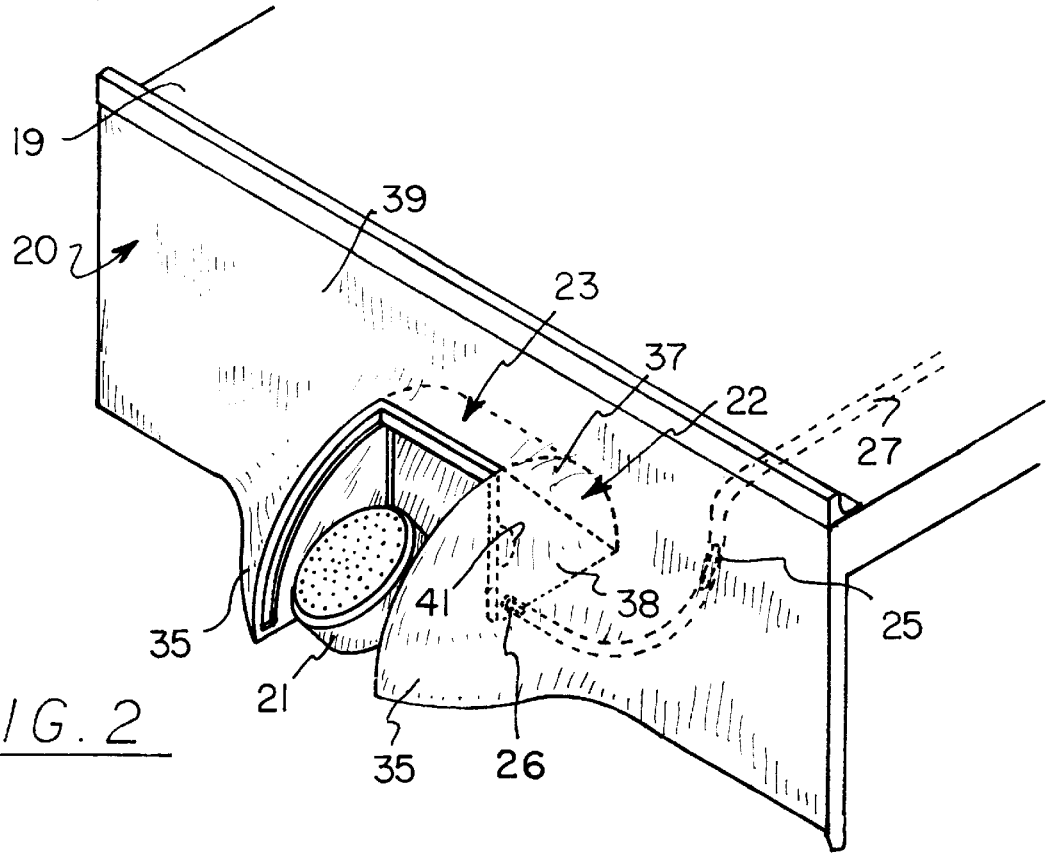
FIG. 2 is a schematic perspective view of the bidet portion of the main member of the present invention.
Figure 3:
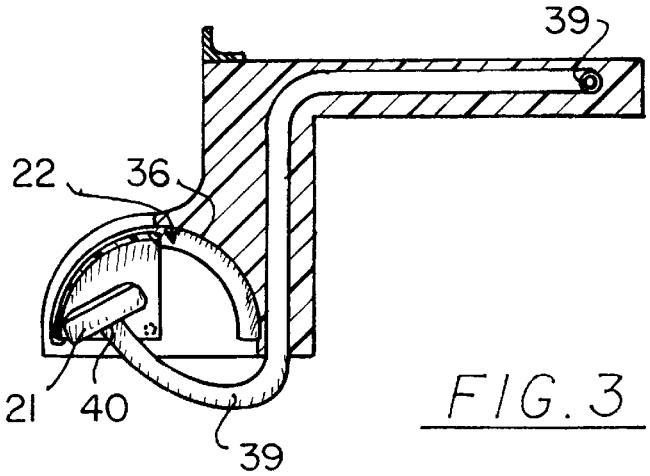
FIG. 3 is a schematic cross sectional view of the main member of the present invention.
Figure 4:
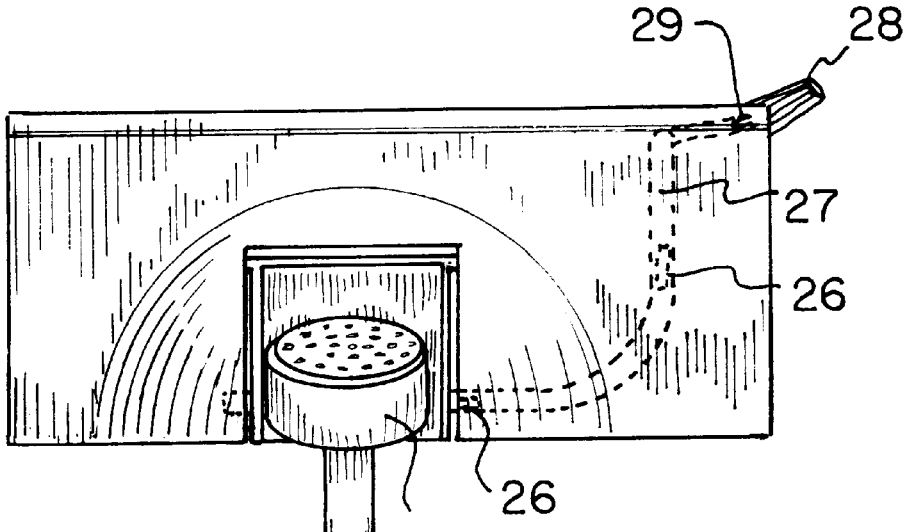
FIG. 4 is a schematic front view of the bidet portion of the main member of the present invention.
Figure 5:
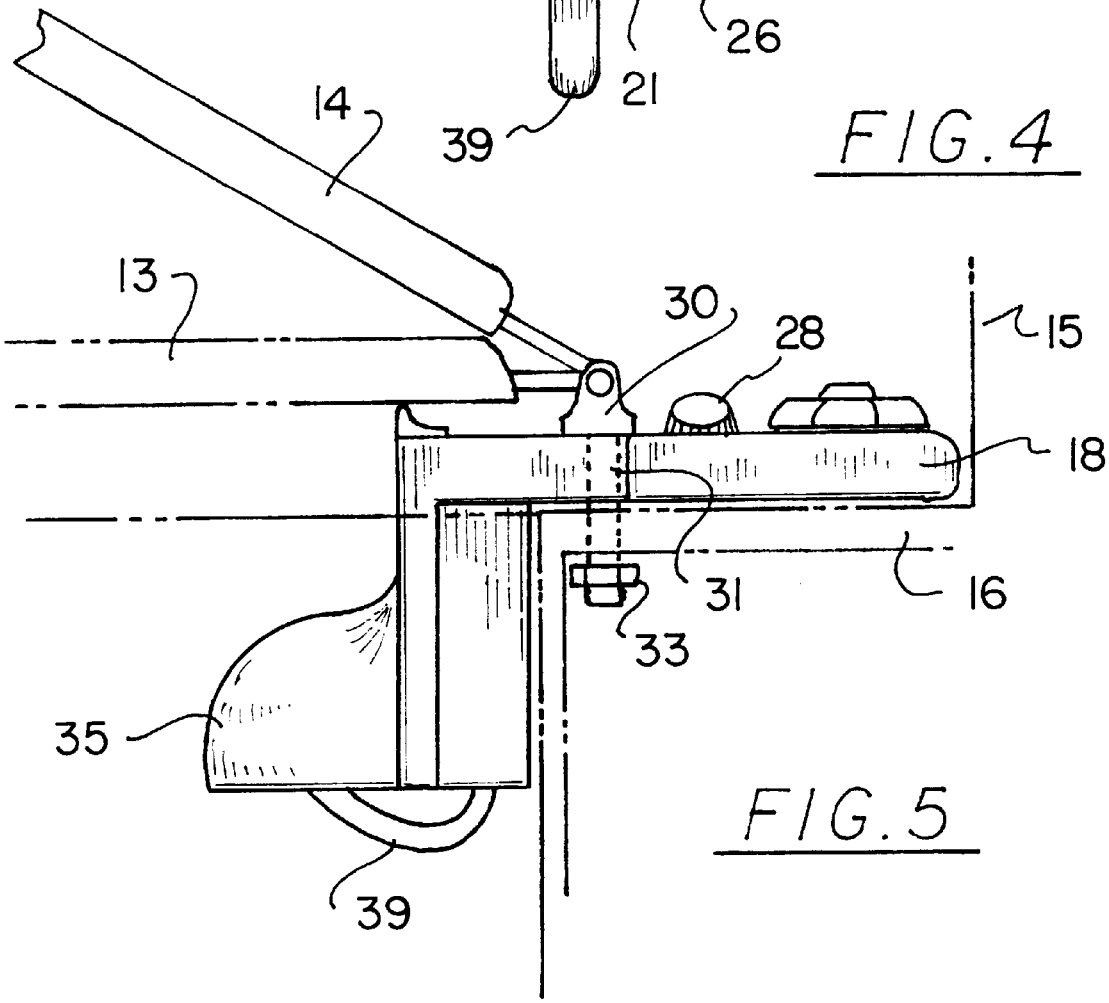
FIG. 5 is a schematic side view of the present invention.

With reference now to the drawings, and in particular to FIGS. 1 through 5 thereof, a new toilet and bidet assembly embodying the principles and concepts of the present invention and generally designated by the reference numeral 10 will be described.

As best illustrated in FIGS. 1 through 5, the toilet and bidet assembly 10 generally comprises a toilet 11 that has a toilet bowl 12, a toilet seat 13, a toilet lid 14, and a toilet tank 15. The toilet bowl 12 has a rear portion 16 and a bowl portion 17 that extends outward from the rear portion 16.

A main member 18 is coupled to the toilet bowl 12. The main member 18 has a mounting portion 19 and a bidet portion 19. The bidet portion 20 extends from the mounting portion 19 into an interior space defined by the bowl portion 17 of the toilet bowl 12.

A spray nozzle 21 is coupled to the bidet portion 20 of the main member 18. The spray nozzle 21 is positioned in a manner such that the spray nozzle 21 directs water through the spray nozzle 21 towards the anus of a user when the user is seated on the toilet seat 13.

A cover member 22 is pivotally coupled to the bidet portion 20. The cover member 22 is selectively pivoted between an open position 23 and a closed position 24. The open position 23 is defined when the cover member 22 is retracted relative to the bidet portion 20. The open position 23 permits the spraying of water on the user when the user is seated on the toilet seat 13. The closed position 24 is defined when the cover member 22 is positioned between and the spray nozzle 21 and the user. The closed position 24 prevents the spray nozzle 21 from spraying water on a user when the user is seated on the toilet seat 13.

A cable 25 that has a first end 26 is coupled to the cover member 22 in a manner such that the first end 26 of the cable 25 is positioned substantially coaxial to an axis about which the cover member 22 pivots. Rotation of the cable 25 pivots the cover member 22 between the open position 23 and the closed position 24.

A channel 27 extends through the main member 18. The cable 25 is positioned to extend through the channel 27. A cap member 28 extends outwardly from the main member 18. The cap member 28 is coupled to a second end 29 of the cable 25 in a manner such that rotation of the cap member 28 rotates the cable 25. Wherein, rotation of the cap member 28 selectively pivots the cover member 22 between its open position 23 and closed position 24.

A pair of connection members 30 are coupled to the toilet seat 13. The rear portion 16 of the toilet bowl 12 has a pair of seat mounting holes 31 that align with the connection members 30 for coupling the toilet seat 13 to the toilet bowl 12.

The mounting portion 19 of the main member 18 includes a pair of slots 32. The slots 32 are positioned so they align with the seat mounting holes 31 in the rear portion 16 of the toilet bowl 12. The mounting portion 19 is positioned between the toilet seat 13 and the toilet bowl 12 by inserting a respective connection member 30 through an associated one of the seat mounting holes 31 of the rear portion 16 of the toilet bowl 12. A pair of nuts 33 are engaged to an associated one of the connection members 30 thereby coupling the toilet seat 13 and main member 18 to the toilet bowl 12.

The bidet portion 20 has a rear wall 34 extending along a rim of the bowl portion 17 of the toilet bowl 12. The bidet portion 20 further has a pair of rounded protrusions 35 that extend outward from the rear wall 34. The cover member 22 and the spray nozzle 21 are positioned between the rounded protrusions 35.

The cover member 22 has an arcuate outer wall 36. The cover member 22 also has a pair of side walls 37 that extend outward from the outer wall 36. In addition, the cover member 22 has a back wall 38 that extends outward from an end of the outer wall 36 and is positioned between the side walls 37.

A nozzle conduit 39 extends through the main member 18. The nozzle conduit 39 has a first end 40 coupled to the spray nozzle 21. The nozzle conduit 39 extends into the rear wall 34 of the bidet portion 20 between the rounded protrusions 35. The back wall 38 of the cover member 22 has a cutout portion 41 for receiving the nozzle conduit 39 when the cover member 22 is in the open position 23.

A mixing valve 42 is coupled to the mounting portion 19. A second end 43 of the nozzle conduit 39 is coupled to the mixing valve 42. Hot and cold water conduits 44, 45 are coupled to the mixing valve 42 for permitting manipulation of the mixing valve 42 to adjust the temperature of water flowing through the nozzle conduit 39 and spraying out of the spray nozzle 21.

The mounting portion 19 of the main member 18 includes an extension portion 46 positioned to extend outward from an edge of the rear portion 16 of the toilet bowl 12. The mixing valve 42 is coupled proximate a distal end of the extension portion 46 of the mounting portion 19 for facilitating manipulation of the mixing valve 42 by a user seated on the toilet seat 13. Moreover, the mixing valve 42 has a handle 47 that extends outward from the extension portion 46 for facilitating grasping of said handle 47 by a user seated on the toilet seat 13.

The cap member 28 extends outward from the extension portion 46 proximate a distal end of the extension portion 46 for facilitating manipulation of said cap member 28 by a user seated on the toilet seat 13. Moreover, the cap member 28 extends upward and outward from the extension portion 46 at an acute angle relative to a plane in which the extension portion 46 lies.

In use, the user sits on the toilet seat 13. The user then simply turns the cap member 28 on the extension portion 46 thereby opening the cover member 22. Then the user rotates the handle 47 on the extension portion 46 thereby adjusting the pressure and temperature of the water flowing through the nozzle conduit 39 and spraying out of the spray nozzle 21. When finished, the user simply rotates the handle 47 to its previous position thereby turning off the water pressure. The cover member 22 can then be returned to its closed position 24 by turning the cap member 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet and bidet assembly, comprising:

a toilet having a toilet bowl, a toilet seat, a toilet lid, and a toilet tank;

said toilet bowl having a rear portion and a bowl portion extending outwardly from said rear portion;

a main member coupled to said toilet bowl, said main member having a mounting portion and a bidet portion, said bidet portion extending from said mounting portion into an interior space defined by said bowl portion of said toilet bowl;

a spray nozzle coupled to said bidet portion of said main member, said spray nozzle being positioned such that said spray nozzle is adapted for directing water through said spray nozzle towards the anus of a user when the user is sealed on the toilet seat;

a cover member pivotally coupled to said bidet portion for selectively pivoting between an open position and a closed position, said open position being defined by said cover member being retracted relative to said bidet portion for permitting spraying of water on the user when the user is seated on said toilet seat and said closed position being defined by said cover member being positioned between said spray nozzle and the user for preventing said spray nozzle from spraying water on a user when said user is seated on said toilet seat; and a cable having a first end coupled to said cover member such that said first end of said cable is positioned substantially coaxial to an axis about which said cover member pivots whereby rotation of said cable pivots said cover member between said open position and said closed position.

2. The toilet and bidet assembly of claim 1, further comprising:

a channel extending through said main member;

said cable being positioned to extend through said channel;

a cap member extending outwardly from said main member, said cap member being coupled to a second end of said cable such that rotation of said cap member rotates said cable whereby said cover member is selectively pivotable between said open position and said closed position by rotating said cap member.

3. The toilet and bidet assembly of claim 2, further comprising:

said mounting portion of said main member including an extension portion positioned to extend outwardly from an edge of said rear portion of said toilet bowl; and said cap member extending outwardly from said extension portion proximate a distal end of said extension portion for facilitating manipulation of said cap member by a user seated on said toilet seat.

4. The toilet and bidet assembly of claim 3, further comprising:

said cap member extending upwardly and outwardly from said extension portion at an acute angle relative to a plane in which said extension portion lies.

5. The toilet and bidet assembly of claim 1, further comprising:

a pair of connection members coupled to said toilet seat;

said rear portion of said toilet bowl having a pair of seat mounting holes alignable with said connection members for coupling said toilet seat to said toilet bowl;

said mounting portion of said main member including a pair of slots, said slots being positioned to align with said seat mounting holes in said rear portion of said toilet bowl whereby said mounting portion is positionable between said toilet seat and said toilet bowl by inserting a respective connection member through an associated one of said seat mounting holes of said rear portion of said toilet bowl; and a pair of nuts, each nut being engageable to an associated one of said connection members whereby said toilet seat and said main member are coupled to said toilet bowl.

6. The toilet and bidet assembly of claim 1, further comprising:

said bidet portion having a rear wall extending along a rim of said bowl portion of said toilet bowl, said bidet portion further having a pair of rounded protrusions extending outwardly from said rear wall; and wherein said cover member and said spray nozzle are positioned between said rounded protrusions.

7. The toilet and bidet assembly of claim 6, further comprising:

said cover member having an arcuate outer wall, a pair of side walls extending outwardly from said outer wall, and a back wall extending outwardly from an end of said outer wall and between said side walls;

a nozzle conduit coupled to said spray nozzle, said nozzle conduit extending into said rear wall of said bidet portion between said protrusions; and said back wall of said cover member having a cutout portion for receiving said nozzle conduit when said cover member is in said open position.

8. The toilet and bidet assembly of claim 1, further comprising:

a nozzle conduit extending through said main member, said nozzle conduit having a first end coupled to said spray nozzle;

a mixing valve coupled to said mounting portion, a second end of said nozzle conduit being coupled to said mixing valve; and hot and cold water conduits coupled to said mixing valve for permitting manipulation of said mixing valve to adjust the temperature of water flowing through said nozzle conduit and spraying out of said spray nozzle.

9. The toilet and bidet assembly of claim 8, further comprising:

said mounting portion of said main member including an extension portion positioned to extend outwardly from an edge of said rear portion of said toilet bowl;

said mixing valve being coupled proximate a distal end of said extension portion of said mounting portion for facilitating manipulation of said mixing valve by a user seated on said toilet seat.

10. The toilet and bidet assembly of claim 9, further comprising:

said mixing valve having a handle extending outwardly from said extension portion for facilitating grasping of said handle by a user seated on said toilet seat.

11. A toilet and bidet assembly, comprising:

a toilet having a toilet bowl, a toilet seat, a toilet lid, and a toilet tank;

said toilet bowl having a rear portion and a bowl portion extending outwardly from said rear portion;

a main member coupled to said toilet bowl, said main member having a mounting portion and a bidet portion, said bidet portion extending from said mounting portion into an interior space defined by said bowl portion of said toilet bowl;

a spray nozzle coupled to said bidet portion of said main member, said spray nozzle being positioned such that said spray nozzle is adapted for directing water through said spray nozzle towards the anus of a user when the user is seated on the toilet seat;

a cover member pivotally coupled to said bidet portion for selectively pivoting between an open position and a closed position, said open position being defined by said cover being retracted relative to said bidet portion for permitting spraying of water on the user when the user is seated on said toilet seat and said closed position being defined by said cover member being positioned between said spray nozzle and the user for preventing said spray nozzle from spraying water on a user when said user is seated on said toilet seat;

a cable having a first end coupled to said cover member such that said first end of said cable is positioned substantially coaxial to an axis about which said cover member pivots whereby rotation of said cable pivots said cover member between said open position and said closed position;

a channel extending through said main member;

said cable being positioned to extend through said channel;

a cap member extending outwardly from said main member, said cap member being coupled to a second end of said cable such that rotation of said cap member rotates said cable whereby said cover member is selectively pivotable between said open position and said closed position by rotating said cap member;

a pair of connection members coupled to said toilet seat;

said rear portion of said toilet bowl having a pair of seat mounting holes alignable with said connection members for coupling said toilet seat to said toilet bowl;

said mounting portion of said main member including a pair of slots, said slots being positioned to align with said seat mounting holes in said rear portion of said toilet bowl whereby said mounting portion is positionable between said toilet seat and said toilet bowl by inserting a respective connection member through an associated one of said seat mounting holes of said rear portion of said toilet bowl;

a pair of nuts, each nut being engageable to an associated one of said connection members whereby said toilet seat and said main member are coupled to said toilet bowl;

said bidet portion having a rear wall extending along a rim of said bowl portion of said toilet bowl, said bidet portion further having a pair of rounded protrusions extending outwardly from said rear wall;

wherein said cover member and said spray nozzle are positioned between said rounded protrusions;

said cover member having an arcuate outer wall, a pair of side walls extending outwardly from said outer wall, and a back wall extending outwardly from an end of said outer wall and between said side walls;

a nozzle conduit extending through said main member, said nozzle conduit having a first end coupled to said spray nozzle, said nozzle conduit extending into said rear wall of said bidet portion between said rounded protrusions;

said back wall of said cover member having a cutout portion for receiving said nozzle conduit when said cover member is in said open position;

a mixing valve coupled to said mounting portion, a second end of said nozzle conduit being coupled to said mixing valve;

hot and cold water conduits coupled to said mixing valve for permitting manipulation of said mixing valve to adjust the temperature of water flowing through said nozzle conduit and spraying out of said spray nozzle;

said mounting portion of said main member including an extension portion positioned to extend outwardly from an edge of said rear portion of said toilet bowl;

said mixing valve being coupled proximate a distal end of said extension portion of said mounting portion for facilitating manipulation of said mixing valve by a user seated on said toilet seat;

said cap member extending outwardly from said extension portion proximate a distal end of said extension portion for facilitating manipulation of said cap member by a user seated on said toilet seat;

said cap member extending upwardly and outwardly from said extension portion at an acute angle relative to a plane in which said extension portion lies; and said mixing valve having a handle extending outwardly from said extension portion for facilitating grasping of said handle by a user seated on said toilet seat.

* * * * *